US009440132B2

(12) United States Patent
Brewer et al.

(10) Patent No.: US 9,440,132 B2
(45) Date of Patent: Sep. 13, 2016

(54) RUNG WALL ASCENDER

(71) Applicants: George W. Brewer, Newton Center, MA (US); Garnet Moore, Brighton, MA (US); W. Conant Brewer, Brookline, MA (US)

(72) Inventors: George W. Brewer, Newton Center, MA (US); Garnet Moore, Brighton, MA (US); W. Conant Brewer, Brookline, MA (US)

(73) Assignee: Brewer's Ledge Inc., Randolph, MA (US)

( * ) Notice: Subject to any disclaimer, the term of this patent is extended or adjusted under 35 U.S.C. 154(b) by 22 days.

(21) Appl. No.: 14/176,868

(22) Filed: Feb. 10, 2014

(65) Prior Publication Data

US 2014/0228177 A1 Aug. 14, 2014

Related U.S. Application Data

(60) Provisional application No. 61/763,428, filed on Feb. 11, 2013.

(51) Int. Cl.

| | |
|---|---|
| ***A63B 22/04*** | (2006.01) |
| ***A63B 69/00*** | (2006.01) |
| ***A63B 22/00*** | (2006.01) |
| ***A63B 21/008*** | (2006.01) |

(52) U.S. Cl.

CPC ..... *A63B 69/0048* (2013.01); *A63B 21/008* (2013.01); *A63B 22/0023* (2013.01); *A63B 22/04* (2013.01)

(58) Field of Classification Search

CPC ..... A63B 22/04; A63B 22/0023

See application file for complete search history.

(56) References Cited

U.S. PATENT DOCUMENTS

| | | | | | |
|---|---|---|---|---|---|
| 481,565 | A | * | 8/1892 | Hunt | 182/43 |
| 3,760,905 | A | * | 9/1973 | Dower | 185/2 |
| 4,200,279 | A | * | 4/1980 | Lambert, Jr. | 482/100 |
| 4,232,630 | A | * | 11/1980 | Orlowski et al. | 119/703 |
| 4,726,581 | A | * | 2/1988 | Chang | 482/53 |
| 4,927,136 | A | * | 5/1990 | Leask | 482/52 |
| 5,549,195 | A | * | 8/1996 | Aulagner | A63B 69/0048 198/850 |

(Continued)

FOREIGN PATENT DOCUMENTS

FR 2713493 * 6/1995

OTHER PUBLICATIONS https://web.archive.org/web/20120221211019/http://www.tanisbrush.com/industrial-brushes/strip-brushes/applications, first documented Feb. 21, 2012).*

(Continued)

*Primary Examiner* — Loan H Thanh
*Assistant Examiner* — Rae Fischer
(74) *Attorney, Agent, or Firm* — Kurt Rauschenbach; Rauschenbach Patent Law Group, LLC

(57) ABSTRACT

A rung wall ascender including a support frame and a rung ladder transport mechanism positioned at a variable angle relative to the support frame. The rung ladder transport mechanism includes a chain arranged as a loop with rung ladders attached to the chain so as to maintain a ladder-like configuration that rotates downward as the user climbs so as to achieve a continuous climbing experience. A hydraulic cylinder is positioned between the rung ladder transport mechanism and the support frame that adjusts an angle of the rung ladder transport mechanism with respect to the ground. A control for the hydraulic cylinder is positioned proximate to the user. A braking system regulates the speed of the rung ladder transport mechanism while the user is climbing.

23 Claims, 7 Drawing Sheets

(56) References Cited

U.S. PATENT DOCUMENTS

| | | | | |
|---|---|---|---|---|
| 5,919,117 | A * | 7/1999 | Thompson | A63B 22/02 198/850 |
| 6,231,482 | B1 * | 5/2001 | Thompson | A63B 22/02 482/37 |
| 7,308,968 | B2 * | 12/2007 | Denison | 182/42 |
| 7,572,208 | B2 * | 8/2009 | Brewer | 482/37 |
| 2006/0240949 | A1 * | 10/2006 | Wu | A63B 22/001 482/37 |
| 2013/0035212 | A1 * | 2/2013 | Chuang et al. | 482/52 |

OTHER PUBLICATIONS https://www.h-p-cosmos.com/en/products/individual-products/discovery-It; retrieved Dec. 29, 2015.

http://www.jacobsladderexercise.com/jacobs-ladder-cardio-machine/; retrieved Dec. 29, 2015.

* cited by examiner

RUNG WALL ASCENDER

CROSS-REFERENCE TO RELATED APPLICATIONS

This application claims priority to U.S. Provisional Patent Application Ser. No. 61/763,428, entitled "Rung Wall Ascender," filed on Feb. 11, 2013. The entire specification of U.S. Provisional Patent Application Ser. No. 61/763,428 is herein incorporated by reference.

INTRODUCTION

The popularity of rock climbing has created a market for artificial climbing walls and other climbing structures. Climbing walls with continuous sliding belts have been recently developed to accommodate climbers with limited space. These climbing walls are popular in various gym environments. Such climbing structures provide a continuous climbing surface for recreation, training, rehabilitation, and fitness purposes in a modest foot print that can easily fit into a gym. Some known climbing walls with continuously sliding belts are powered by electric motors. Other climbing walls, such as the climbing walls manufactured by Brewer's Ledge Inc., the assignee of the present application, use the climber's own weight to power sliding belts.

More recently, ladder-type climbing structures have become available. These ladder-type climbing structures are highly suitable for gym use and have numerous advantages over stair climbing machines because they use more muscle groups. In contrast to stair climbers, the user ascends using both arms and legs, which enhances the effectiveness of the workout. Currently existing ladder-type climbing structures have significant limitations. One limitation is that known ladder-type climbing structures position the ladder at a fixed angle relative to the ground. Another limitation is that they require that the user wear a harness or be otherwise tethered to the machine to activate a stopping mechanism. For example, commercially available ladder-type climbing structures known as Jacobs Ladders, have the ladder-type climbing structure positioned at a fixed angle of 40 degrees and utilize a body harness as part of the control mechanism.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

DESCRIPTION OF VARIOUS EMBODIMENTS

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings may be performed in any order and/or simultaneously as long as the teaching remains operable. Furthermore, it should be understood that the apparatus and methods of the present teachings can include any number or all of the described embodiments as long as the teaching remains operable.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

Figure 1:
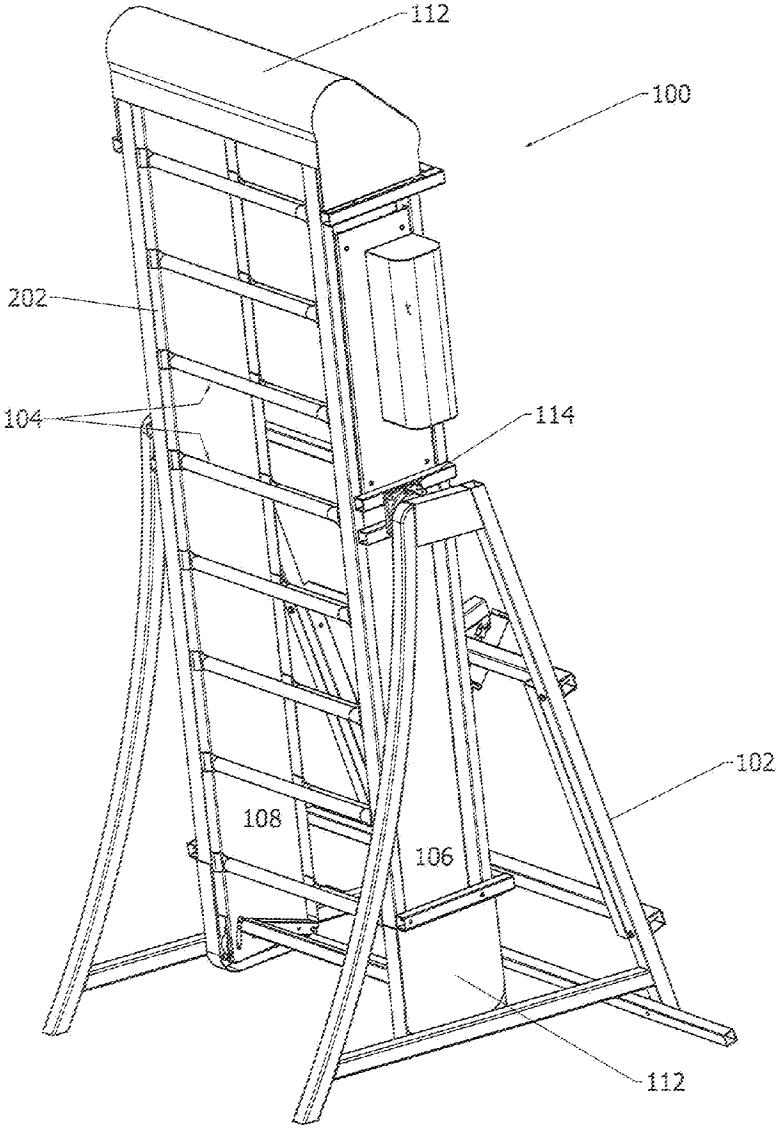
FIG. 1 illustrates a perspective view of the rung wall ascender according to one embodiment of the present teaching.

The present teaching relates to a rung ladder ascender for climbing having a plurality of ladder rungs and numerous advantages over the prior art. FIG. 1 illustrates a perspective view of the rung wall ascender 100 according to one embodiment of the present teaching. The rung wall ascender 100 includes a support frame 102 that supports a rung ladder transport mechanism comprising the rung ladders 104. In one embodiment, the ladder rungs 104 are formed of brushed stainless steel, which is attractive and durable. In other embodiments, the ladder rungs 104 are formed of a metal having a powder coated metal surface.

The rung ladder ascender 100 includes a first 106 and a second side member 108 that each form a channel 202 for a chain or other rung ladder transport mechanism. One skilled in the art will appreciate that the present teachings are not limited to chain driven mechanisms and that the present teachings are broad enough to cover belt drive and other rung ladder transport mechanisms. The chain is arranged as a loop that maintains the rungs into a ladder-like configuration that rotates downward as the user climbs so as to achieve a continuous climbing experience.

Figure 2:
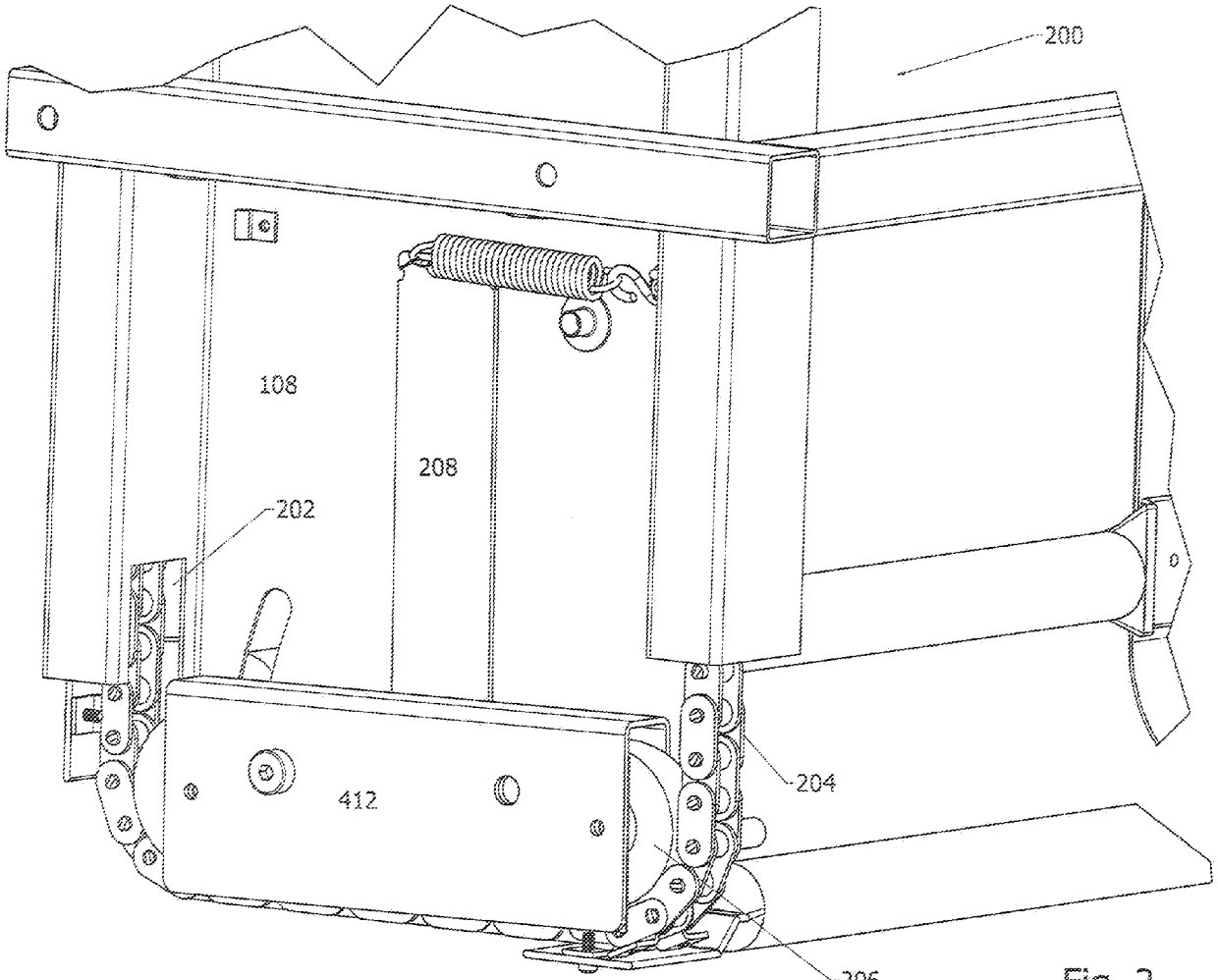
FIG. 2 illustrates a bottom end of one of the first and second side members according to the present teaching.

FIG. 2 illustrates a bottom end 200 of one of the first and second side members 106, 108 according to the present teaching. Many parts of the transport mechanism are safely hidden from the user's body parts and clothing. Referring to FIGS. 1 and 2, the first and second side members 106, 108 include guiding channels 202 for passing a chain 204. In one specific embodiment, the chains are a standard "K1" attachment chain number 60 that have two attachment tabs every 12 inches, which correspond to attachment tabs every 16th link. In various embodiments, the chain 204 can be fitted with plastic wear-strips or some other type of wear-strip.

In one particular embodiment of the rung wall ascender 100, each side channel is bent from a single piece of sheet metal with the guiding channels integrally bent at the front and back edge. This configuration forms a deep indentation running down the middle on the outside that is large enough to accommodate mechanical components for the chain transport mechanism, such as idler wheels, drive chain, sprockets, control rods, springs, etc. The channels 202 are held in rigid alignment as a single unit with three C-shaped members, which are welded to the two channels and pass around the back of the machine. The resulting rigidity and alignment are important for proper operation.

In one embodiment, the ends of the channels 202 and the shrouds 112 at the top and bottom of the machine are matched so that all mechanical parts are hidden from view both from the inside and from the outside. However, the guiding channels 202 themselves are open in some embodiments, exposing the attachment chain 204 to view. Strip-brushes can be mounted over the channels 202 to block the chain 204 from sight and to prevent the user's fingers and clothing from being caught by the chain 204.

Large bearings 114 are mounted at the right and left sides of the rung ladder assembly 100 about half way up, and the channel unit is suspended from these bearings. The bearings are mounted so that the center of gravity of the channel unit is slightly behind the pivot point, so that there is a natural tendency for the bottom of the unit to swivel forward into a more horizontal "slab" orientation.

Each of the first and second side members 106, 108 has two ends that each includes a chain transport mechanism 206. In the example shown, the chain transport mechanism 206 includes a first and a second chain pulley for transporting the chain 204 from one end to the other end. In other embodiments, sprockets are used instead of pulleys. In some embodiments, the chain transport mechanism 206 includes one or more tensioning mechanisms 208 that control the tension of the chain 204 on the chain transport mechanism 206. The tensioning mechanisms 208 can be spring loaded tension mechanisms, such as the one shown in FIG. 2. Numerous other types of tensioning mechanisms can be used, and in many embodiments, the tensioning mechanisms are adjustable.

Figure 3A:
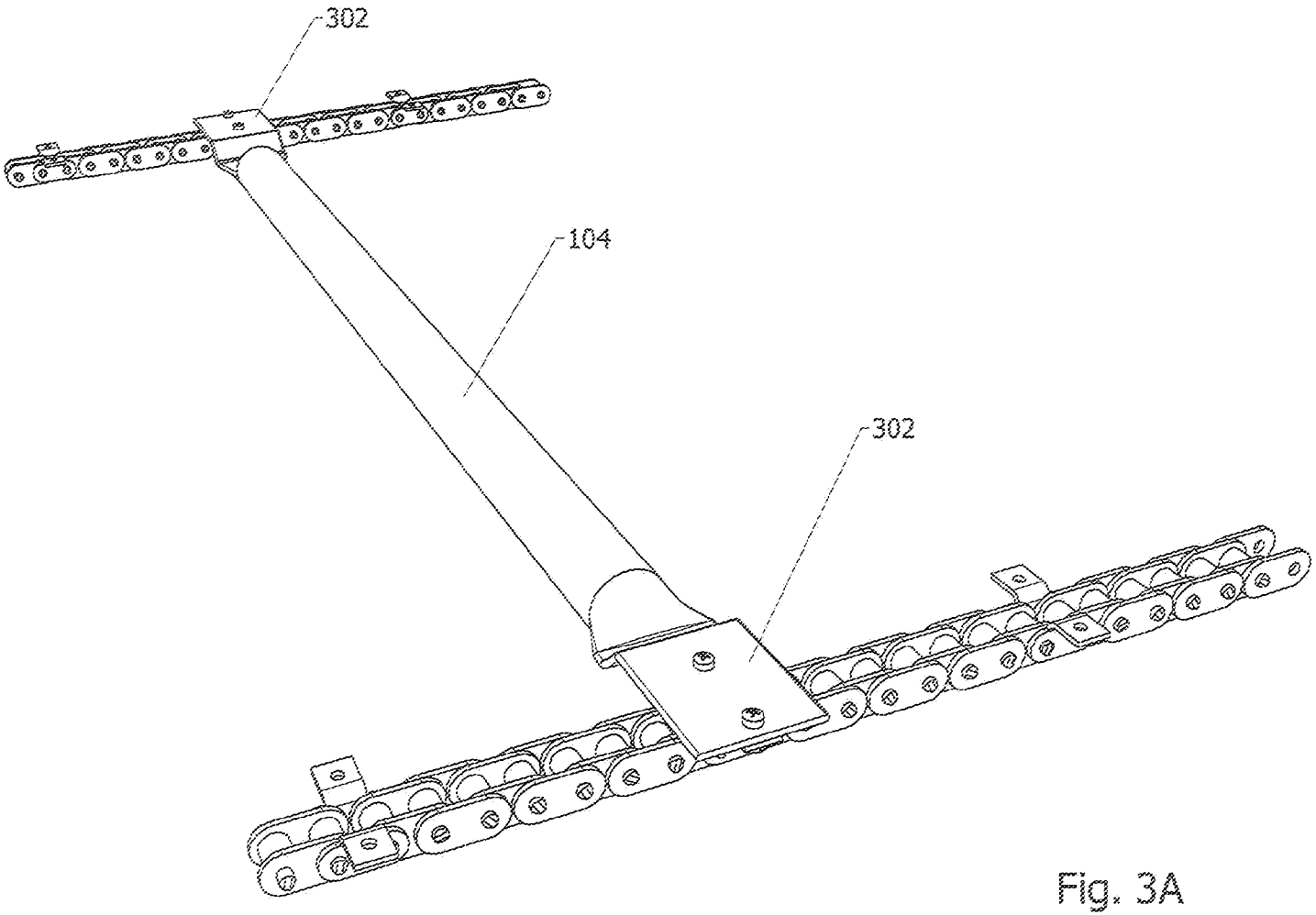
FIG. 3A illustrates a front-view of the attachment of a ladder rungs to the chain.
Figure 3B:
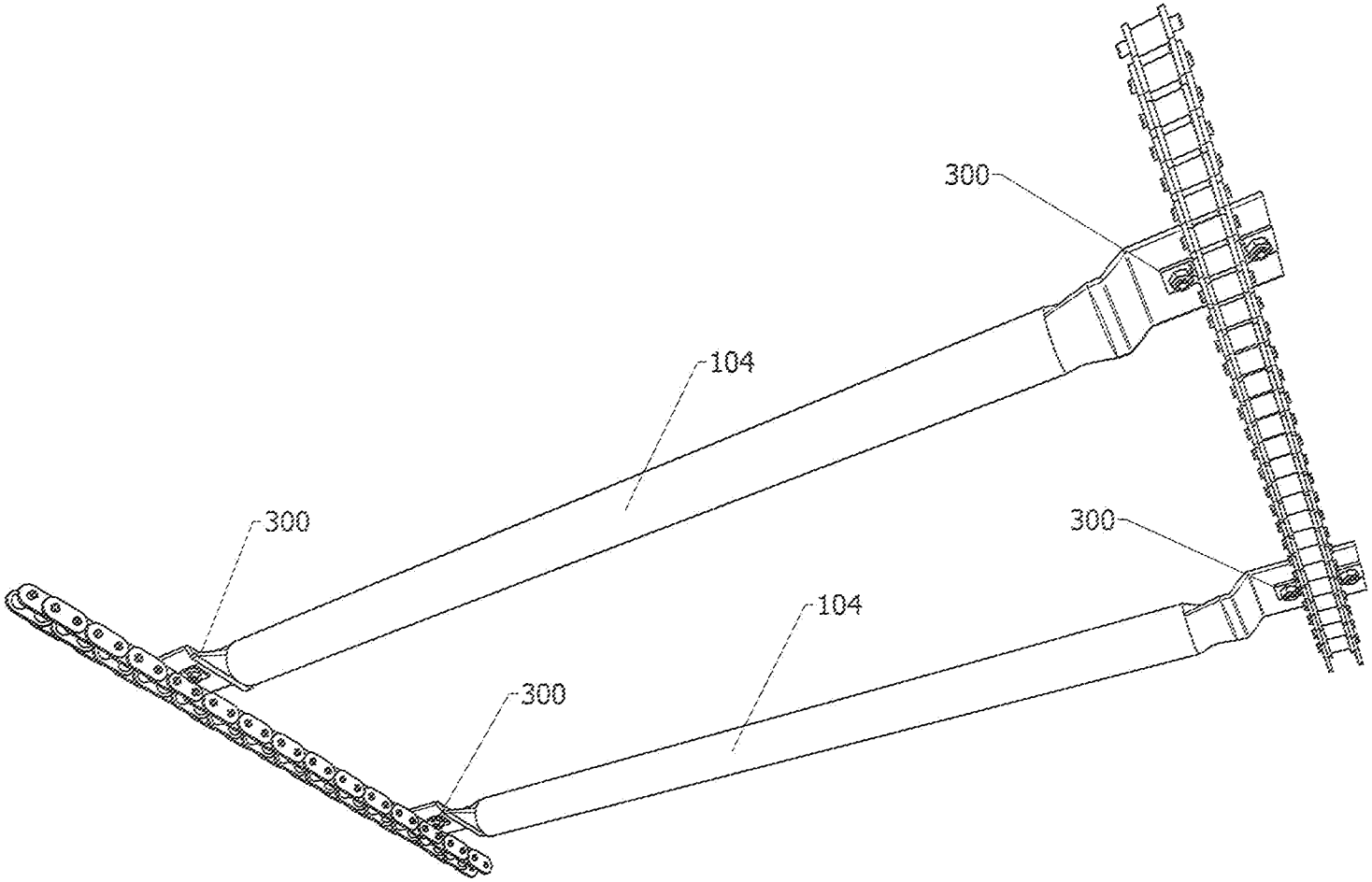
FIG. 3B illustrates a back-view of the attachment of a ladder rungs to the chain.

FIG. 3A illustrates a front-view of the attachment of a ladder rung 104 to the chain 204. FIG. 3B illustrates a back-view of the attachment of a ladder rung 104 to the chain 204. Referring to FIGS. 1, 2, 3A, and 3B, the ends of the ladder rungs 104 are bolted onto the chain 204 using clamps 300. In one embodiment, the rung wall ascender 100 includes a series of horizontal ladder rungs 104 with flattened ends 302 that are bolted to the chain 204 moving through the channels 202 in the first and second ends 106, 108. One skilled in the art will appreciate that there are numerous other means of attaching the ladder rungs 104 to the chain 204. In one specific embodiment, the ladder rungs 104 are mounted to the chain 204 with screws. Machine screws with high-profile fillister heads, which are sometimes know as "cheese-heads" can be used. Fillister head screws which can be assembled close to flanges and raised surfaces can also be used.

In the specific embodiment shown in FIGS. 3A and 3B, the ladder rungs 104 are fabricated from metal tubing with flattened ends 302, which facilitate mounting to the chain 204 as shown in FIGS. 3A and 3B. There is an intentional offset in the flattened end 302 so that the center axis of the ladder rung 104 is in alignment with the pivot point of the chain 204 links. This feature has significant advantages. One advantage is that it prevents the weight of the climber from creating a torque on the tube, which would increase undesirable friction that causes wear in the guiding channels. Such wear in the guiding channels 202 will eventually cause a failure in the apparatus.

Figure 4:
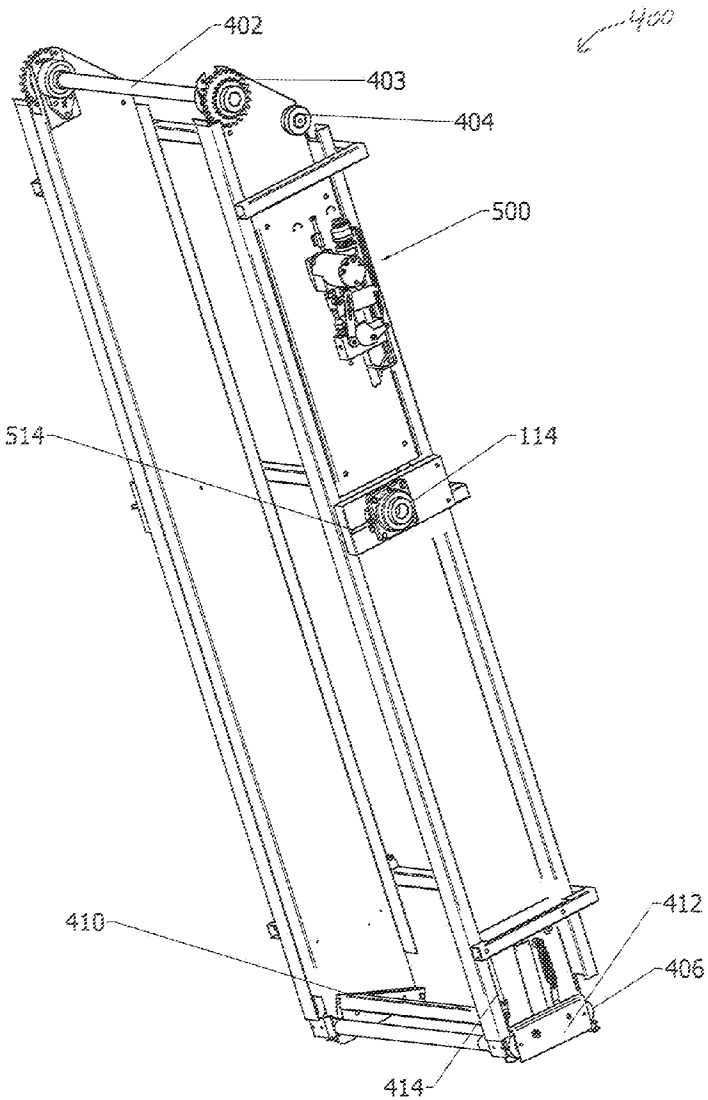
FIG. 4 illustrates a more detailed perspective view of the rung wall ascender according to one embodiment of the present teaching, which illustrates certain features.

FIG. 4 illustrates a more detailed perspective view of the rung wall ascender 400 according to one embodiment of the present teaching. One feature illustrated in FIG. 4 that is included in some embodiments of the present teaching where two chain or belt loops are used on either side of the rungs, is a chain synchronizer that maintains the chains in proper relative alignment, and that controls the rate of descent. In one specific embodiment, the chain synchronizer includes a main shaft 402 at the top of the rung wall ascender 400. A sprocket 403 is attached to each end of the main shaft 402. A first set of idler wheels 404 is positioned at the top of the channels 202. An additional set of idlers 406 is positioned at the bottom of the wall in order to guide the chain through the loop. In one embodiment, the idler wheels 406 are held in a pivoting cradle 412 that holds the chain 204 in tension with a spring tension arrangement. In one specific embodiment, the idler wheels 404, 406 are made of a medium-hardness rubber that dampens vibrations that otherwise would create undesirable noise.

Another feature illustrated in FIG. 4 that is included in some embodiments of the present teaching is a relatively large space positioned behind the ladder rungs 104 that accommodates the user's feet. The relatively large space is created in part by the placement of idler wheels 404, 406 at a spacing that creates a proper distance between the front and rear ladder rungs 104 of the loop to accommodate the user.

Yet another feature illustrated in FIG. 4 that is included in some embodiments of the present teaching is a hydraulic braking system 408 that controls the speed of the chain 204 attached to the ladder rungs 104 for users of different weights and climbing activity levels. The hydraulic braking system manages the speed of descent by controlling the flow of hydraulic fluid from a hydraulic pump.

Figure 5:
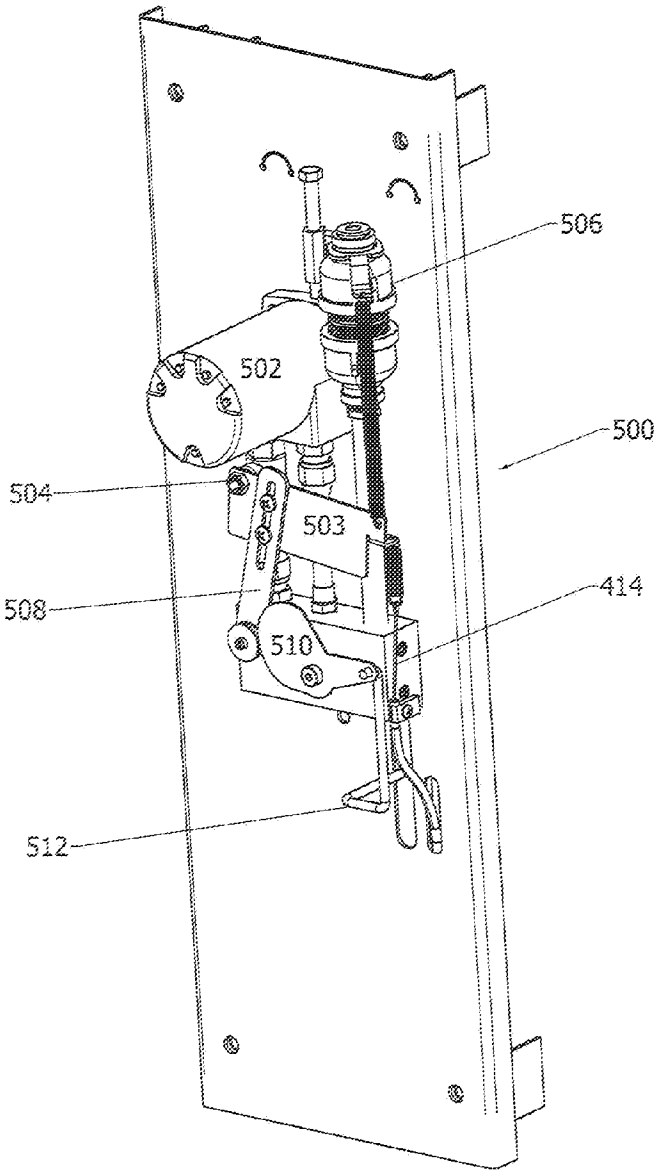
FIG. 5 illustrates one type of hydraulic braking system according to the present teaching.

FIG. 5 illustrates one type of hydraulic braking system 500 according to the present teaching. In one embodiment, the hydraulic braking system 500 is a simple hydraulic circuit including a hydraulic "orbit" motor-pump 502 with a ball valve 504 and hydraulic fluid reservoir 506. The hydraulic braking system 500 can include various types of control means and these control means can be positioned relative to the user so that they are easily adjustable by the user during climbing. One control means controls the hydraulic ball valve 504, which when closed slows and stops the machine. For example, one specific embodiment of a control means adjusts the opening in the hydraulic ball valve 504 by controlling a spring-loaded roller arm 508 that bears against a cam 510. The cam 510 is adjusted with a control rod 512 attached to a lever 514 at the side of the machine. This control means is advantageous because it allows fine control of the flow characteristics of the valve in relation to the position of the operating lever. In addition, this control means is desirable because the climbing characteristics and modes of operation can be changed by simply replacing the cam with a different cam having a shape that results in the desired characteristics. It should be understood that numerous other active and passive braking systems can be used with the rung wall ascender of the present teaching.

Another feature illustrated in FIG. 4 that is included in some embodiments of the present teaching is a braking system 410 for the rung ladder ascender. Braking occurs when the climber stops climbing and descends to the bottom of the wall. The braking system 410 includes a spring-loaded hinged bar at the bottom of the wall in close proximity behind the ladder rungs, which the climber's foot naturally contacts and depresses. In many embodiments, the hinge bar at the bottom of the wall has adequate travel in excess of the braking motion so as to prevent entrapment of the user's foot from descending rungs. A cable 414 attached to the spring-loaded hinged bar leads up to the control mechanism and closes the hydraulic ball valve 504 (FIG. 5) when the bar is depressed. This gently stops the machine, which then waits until the user starts climbing again or gets off. Without this type of braking system, the wall would not stop and the climber's foot would follow the rung under the bottom of the machine, which causes an unpleasant sensation, and could in some circumstances damage the ladder rung 104 or injure the user.

Another feature illustrated in FIG. 4 that is included in some embodiments of the present teaching is an angle control system that adjusts the angle of the rung wall ascender with respect to the ground. One aspect of the present teaching is that the rung wall ascender can be configured to a variety of angles so that the climber can enjoy various climbing experiences. For example, the rung wall ascender 100 can be configured as a vertical-only climber with a simple frame that supports it in an upright position. Alternatively, the rung wall ascender 100 can be configured as a variable angle ladder that is adjustable from a positive "slab" angle to a challenging overhang. During climbing, the angle may be adjusted by the user to as steep of an angle as desired. Angle adjustment is also passive, the weight of the climber and the balance of the machine itself makes it easy to adjust the angle.

In operation, the rung wall ascender of the present teaching utilizes the user's natural climbing movements to power the apparatus. That is, the rung wall ascender 100 is passive in that the movement of the ladder rungs 104 and adjustment of the angle is entirely due to the actions and weight of the climber. There is no active drive and the apparatus does not require any electrical power either directly or indirectly to operate. When the user steps onto the machine, the center of gravity moves forward, and the wall tends to swivel backwards into the overhanging direction. A hydraulic cylinder as described in connection with FIG. 6 holds the wall rigidly so it cannot swivel without user activity.

Figure 6:
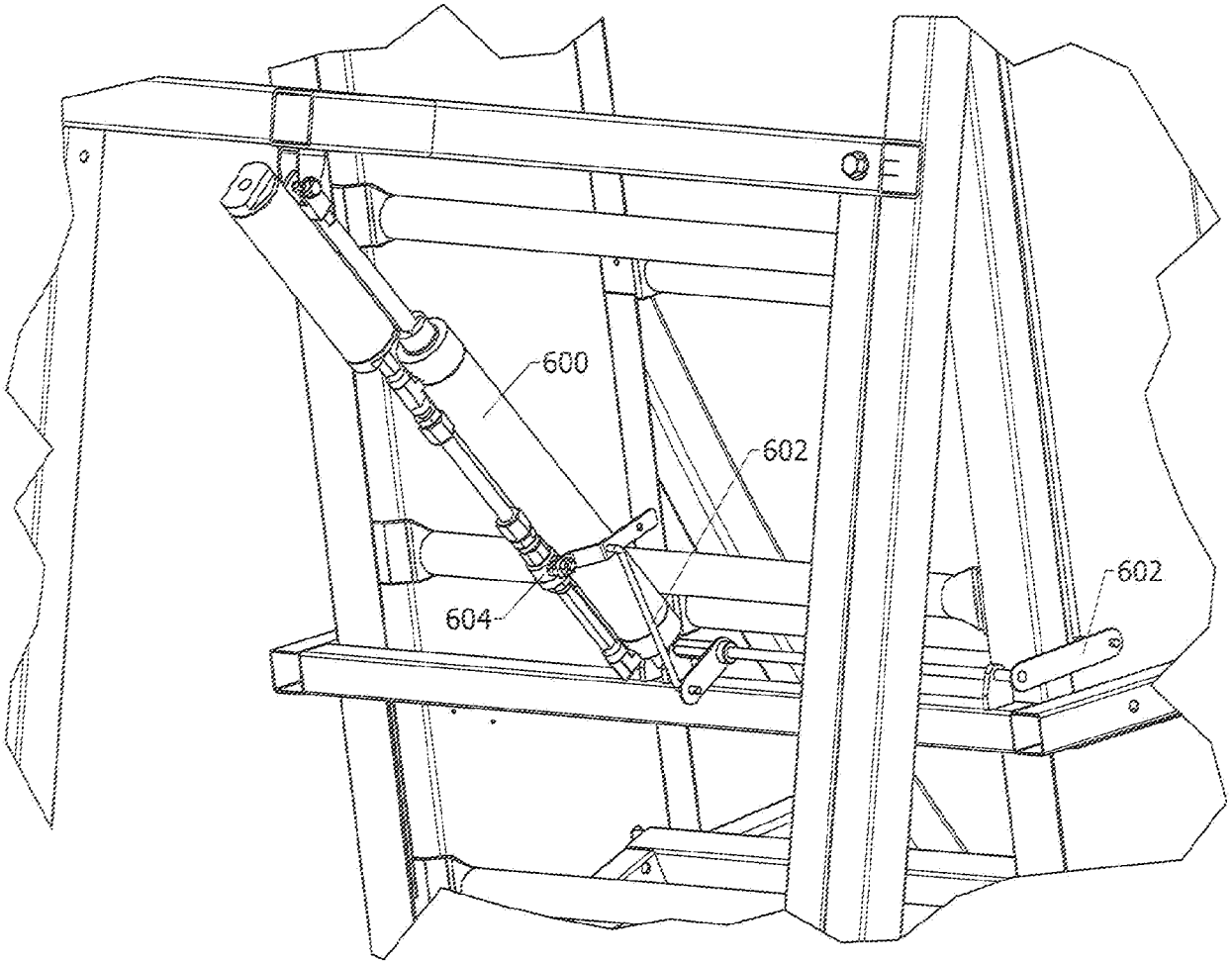
FIG. 6 illustrates a back-view of the rung wall ascender showing a hydraulic cylinder for stabilizing the rung ladder assembly.

FIG. 6 illustrates a back-view of the rung wall ascender showing a hydraulic cylinder for stabilizing the rung ladder assembly 100. At the back of the machine, a hydraulic cylinder 600 holds the wall rigidly so it cannot swivel. The user has access to a lever 602 that can open a valve 604 on the cylinder 600. This allows the hydraulic fluid in the cylinder 600 to flow and releases the rung ladder assembly 100. In operation, when the user activates the lever 602, the rung ladder assembly 100 will move forward to the more horizontal "slab" position if the user is off the wall. If the user is climbing on the machine, the rung ladder assembly 100 will move backwards towards a more vertical or overhanging position. This allows the user to increase the angle while climbing and to reset the machine when off the wall.

Alternatively or in addition to the hydraulic cylinder 600, gas springs can be used to control the angle of the rung ladder assembly 100. Gas springs are advantage because they are less expensive. One type of suitable gas spring is the Stabilus LIFT-O-MAT PTL, which is commercially available.

EQUIVALENTS

While the applicants' teaching is described in conjunction with various embodiments, it is not intended that the applicants' teaching be limited to such embodiments. On the contrary, the applicants' teaching encompass various alternatives, modifications, and equivalents, as will be appreciated by those of skill in the art, which may be made therein without departing from the spirit and scope of the teaching.

What is claimed is:

1. A rung wall ascender comprising:

a) a support frame;

b) a rung ladder transport mechanism positioned at a variable angle relative to a vertical surface of the support frame, the rung ladder transport mechanism comprising a chain arranged as a loop with a plurality of ladder rungs attached to the chain, each of the plurality of ladder rungs being positioned so as to maintain a ladder-like configuration that rotates downward as the user climbs so as to achieve a continuous climbing experience, wherein a center of gravity of the rung ladder transport mechanism is such that when the user is not on the rung ladder transport mechanism, the mechanism tends to swing forward into a horizontal-slab position, and when the user is on the rung ladder transport mechanism, the rung ladder transport mechanism tends to swing backwards towards a substantially vertical direction; and d) a braking system that regulates the speed of the rung ladder transport mechanism while the user is climbing.

2. The rung wall ascender of claim 1 wherein the support frame comprises a guiding channel for the chain.

3. The rung wall ascender of claim 2 wherein the rung ladder transport mechanism comprises at least one bearing that supports the rung ladder transport mechanism on the support frame.

4. The rung wall ascender of claim 3 wherein the at least one bearing is positioned on the rung ladder transport mechanism so that the center of gravity of the rung ladder transport mechanism is behind a pivot point such that there is a tendency for a bottom of the rung ladder transport mechanism to swivel forward.

5. The rung wall ascender of claim 2 further comprising at least one set of idler wheels that guide the chain through the guiding channel.

6. The rung wall ascender of claim 1, wherein the rung ladder transport mechanism comprises a first and second chain pulley or a first and second chain sprocket for transporting the chain from one end of the rung ladder transport mechanism to the other.

7. The rung wall ascender of claim 1 further comprising at least one chain tensioner that controls the tension of the chain in the chain transport mechanism.

8. The rung wall ascender of claim 7 wherein the at least one chain tensioner is adjustable.

9. The rung wall ascender of claim 1 wherein the ladder rungs comprise flattened ends.

10. The rung wall ascender of claim 9, wherein the ladder rungs each comprise a longitudinal center line, and wherein the flattened ends of the ladder rungs are offset from the longitudinal center line and the longitudinal center line of each ladder rung is in alignment with the pivot point of a chain link.

11. The rung wall ascender of claim 1 wherein the braking system comprises a hydraulic braking system.

12. The rung wall ascender of claim 11 wherein the hydraulic braking system comprises an orbit motor-pump with a ball valve and hydraulic fluid reservoir.

13. The rung wall ascender of claim 11, wherein a user control for the hydraulic braking system is positioned in a location proximate to the user to control the braking during climbing.

14. The rung wall ascender of claim 11, wherein the hydraulic braking system is activated by a spring-loaded hinge bar positioned behind the ladder rungs.

15. The rung wall ascender of claim 1 further comprising a hydraulic cylinder positioned between the rung ladder transport mechanism and the support frame that adjusts an angle of the rung ladder transport mechanism with respect to ground, a control for the hydraulic cylinder being positioned proximate to the user.

16. The rung wall ascender of claim 1 further comprising a gas spring that controls the angle of the rung ladder transport mechanism.

17. A rung wall ascender comprising:

a) a support frame;

b) a rung ladder transport mechanism positioned at a variable angle relative to a vertical surface of the support frame, the rung ladder transport mechanism comprising a belt arranged as a loop with a plurality of ladder rungs attached to the belt, each of the plurality of ladder rungs being positioned so as to maintain a ladder-like configuration that rotates downward as the user climbs so as to achieve a continuous climbing experience, wherein a center of gravity of the rung ladder transport mechanism is such that when the user is not on the rung ladder transport mechanism, the mechanism tends to swing forward into a horizontal-slab position, and when the user is on the rung ladder transport mechanism, the rung ladder transport mechanism tends to swing backwards towards a substantially vertical direction; and d) a braking system that regulates the speed of the rung ladder transport mechanism while the user is climbing.

18. The rung wall ascender of claim 17 further comprising a hydraulic cylinder positioned between the rung ladder transport mechanism and the support frame that adjusts an angle of the rung ladder transport mechanism with respect to ground, a control for the hydraulic cylinder being positioned proximate to the user.

19. The rung wall ascender of claim 17 further comprising a gas spring that controls the angle of the rung ladder transport mechanism.

20. A rung wall ascender comprising:

a) a support frame;

b) a rung ladder transport mechanism positioned at a variable angle relative to a vertical surface of the support frame, the rung ladder transport mechanism comprising a first and second chain arranged as first and second loops with a first end of a plurality of ladder rungs being attached to the first chain and a second end of the plurality of ladder rungs being attached to a second chain so as to maintain a ladder-like configuration that passively rotates downward as the user climbs so as to achieve a continuous climbing experience, wherein a center of gravity of the rung ladder transport mechanism is such that when the user is not on the rung ladder transport mechanism, the mechanism tends to swing forward into a horizontal-slab position, and when the user is on the rung ladder transport mechanism, the rung ladder transport mechanism tends to swing backwards towards a substantially vertical direction; and d) a braking system that regulates the speed of the rung ladder transport mechanism while the user is climbing.

21. The rung wall ascender of claim 20 further comprising a chain synchronizer that maintains the first and second chains in proper relative alignment and that controls a rate of descent.

22. The rung wall ascender of claim 20 further comprising a hydraulic cylinder positioned between the rung ladder transport mechanism and the support frame that adjusts an angle of the rung ladder transport mechanism with respect to ground, a control for the hydraulic cylinder being positioned proximate to the user.

23. The rung wall ascender of claim 20 further comprising a gas spring that controls the angle of the rung ladder transport mechanism.

* * * * *